United States Patent [19]

Smith

[11] 4,078,532

[45] Mar. 14, 1978

[54] FUEL ECONOMIZER

[76] Inventor: Joseph A. Smith, 2214 E. 4th, Lot 37, Chief Mobile Park, Hutchinson, Kans. 67501

[21] Appl. No.: 497,882

[22] Filed: Aug. 16, 1974

[51] Int. Cl.[2] ..... F02M 31/00

[52] U.S. Cl. ..... 123/122 AC; 123/122 AB

[58] Field of Search ..... 123/122 AC, 141; 261/144, 145; 48/180 R

[56] References Cited

U.S. PATENT DOCUMENTS

| | | | |
|---|---|---|---|
| 1,515,408 | 11/1924 | Puffer | 48/180 R |
| 1,691,615 | 11/1928 | Smith | 123/122 AC |
| 1,706,845 | 3/1929 | Eynon | 48/180 R |
| 1,744,319 | 1/1930 | Link | 123/122 AC |
| 2,353,665 | 7/1944 | Haibe | 48/180 R |
| 2,857,898 | 10/1958 | Cohn | 123/122 AC |
| 3,625,190 | 12/1971 | Boissevain | 123/122 AC |

FOREIGN PATENT DOCUMENTS

| | | | |
|---|---|---|---|
| 567,953 | 1/1933 | Germany | 48/180 R |

*Primary Examiner*—Ronald H. Lazarus
*Attorney, Agent, or Firm*—Head, Johnson & Chifin

[57] ABSTRACT

A fuel economizer device adapted to be interposed between the usual carburetor and manifold of an internal combustion engine, or the like, for substantially vaporizing the fuel prior to discharge thereof into the manifold and comprising a plate member having a plurality of spaced apertures for passing the fuel therethrough, said plate being disposed in relation to the manifold for being heated thereby during operation of the engine whereby fuel impinging thereon is substantially vaporized. In addition, a plurality of spaced detents or indentations are provided on the leading face of the plate for an accumulation of liquid fuel therein which has not been vaporized. The fuel trapped in the indentations is heated to the boiling point thereof which results in a substantially complete vaporization of the fuel stream prior to discharge thereof into the manifold for distribution to the combustion chamber.

3 Claims, 3 Drawing Figures

FUEL ECONOMIZER

BACKGROUND OF THE INVENTION

1. Field of the Invention

This invention relates to improvements in fuel economizer devices and more particularly, but not by way of limitation, to an apertured plate member adapted to be interposed between a carburetor and a manifold for heating the fuel stream for a substantial vaporization thereof. 2. Description of the Prior Art In view of the current energy crisis and environmental problems, much consideration is being given to ways for increasing the efficiency of fuel usage in internal combustion engines, and the like, and a corresponding decrease in undesirable exhaust pollutants. It is recognized that one secret of fuel economy is treating the fuel mixture in some manner to increase the percentage of combustion thereof, which not only increases the efficient use of the fuel, but reduces exhaust of pulluting gases since a greater portion of the fuel is actually consumed rather than wasted by venting into the atmosphere. However, the usual devices available today for vaporization of the fuel for increased combustion thereof are expensive and frequently cause damage to other portions of the engine.

SUMMARY OF THE INVENTION

The present invention contemplates a novel fuel economizer apparatus which comprises a substantially flat plate adapted to be interposed between the usual carburetor fuel outlet and the usual manifold intake port for treating the fuel mixture leaving the carburetor in a manner to substantially completely vaporize the mixture prior to entry of the fuel into the manifold for distribution to the combustion chamber. The plate is provided with a plurality of spaced apertures which permit the passage of the fuel mixture from the carburetor to the manifold, and is disposed in relation to the manifold for being heated during operation of the engine, or the like. As the fuel mixture passes across the plate, the heat is transmitted thereto for vaporization of a substantial quantity of the fuel. A plurality of detents or indentations are also provided on the leading face of the plate member, and any liquid fuel which is not vaporized by the radiant heat from the plate may accumulate within the indentations wherein it is heated to the boiling point thereof for further vaporization of the fuel stream, thus resulting in a substantially complete vaporization of the fuel prior to admission thereof into the manifold for distribution to the combustion chamber. The novel device is simple and efficient in operation and economical and durable in construction.

DESCRIPTION OF THE PREFERRED EMBODIMENT

Figure 1:
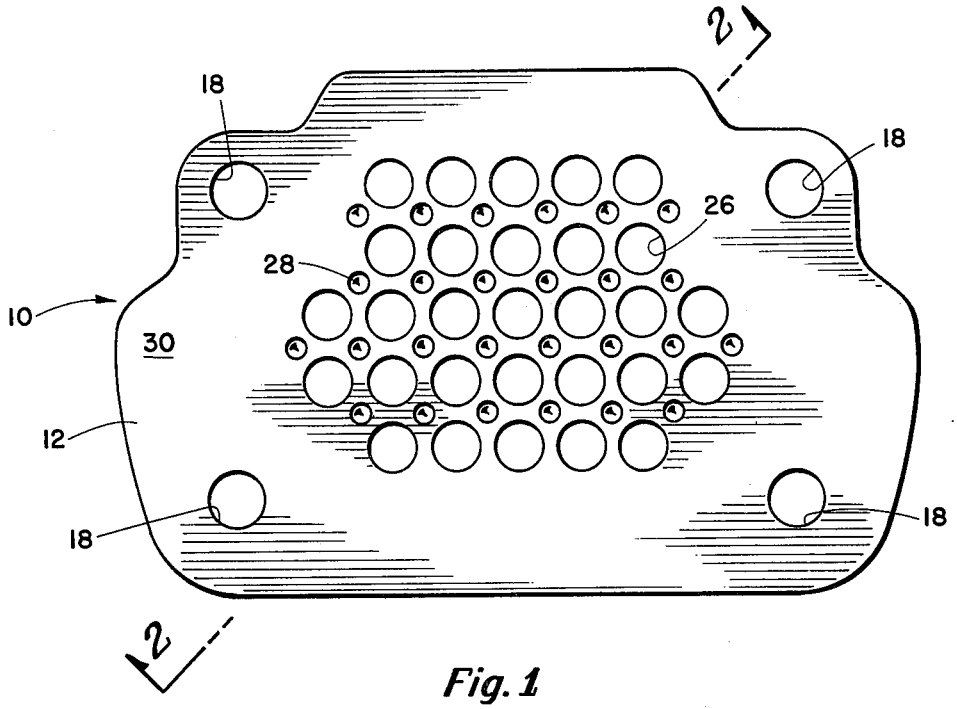
FIG. 1 is a plan view of a fuel economizer embodying the invention.
Figure 2:
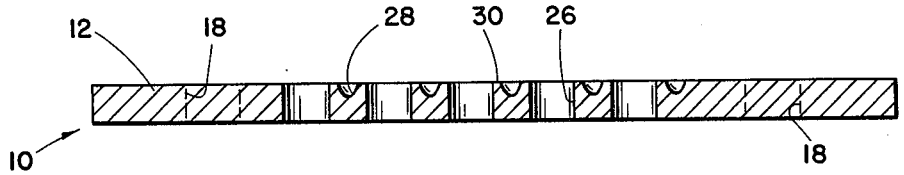
FIG. 2 is a sectional view taken on line 2-2 of FIG. 1.
Figure 3:
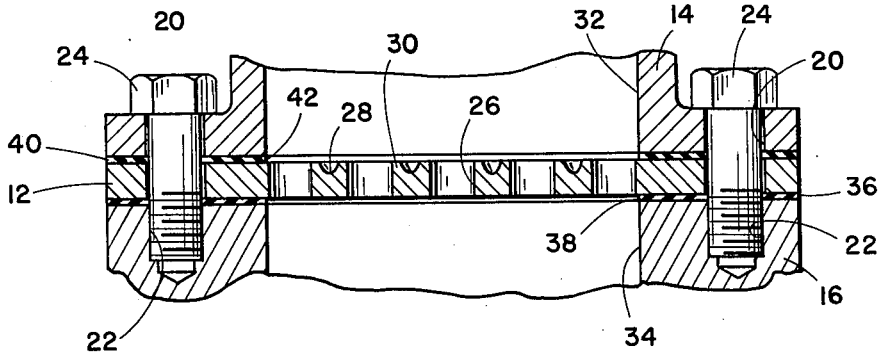
FIG. 3 is a sectional view of a fuel economizer embodying the invention as installed between a carburetor and manifold.

Referring to the drawings in detail, reference character 10 generally indicates a fuel economizer comprising a substantially flat plate 12 constructed from any suitable heat conducting material and adapted to be interposed between substantially any carburetor 14 and manifold 16 of substantially any type engine (not shown) such as an internal combustion engine, utilizing an air-fuel mixture. The plate 12 is of an outer configuration complementary to the carburetor 14 and manifold 16 with which it is to be utilized as will be hereinafter set forth, and is provided with a plurality of spaced mounting apertures 18 disposed in substantial alignment with the mounting apertures 20 and 22 of the carburetor 14 and manifold 16, respectively, whereby the plate 12 may be disposed between the carburetor 14 and manifold 16 and secured thereto by suitable mounting bolts 24 as will be hereinafter set forth.

A plurality of spaced apertures 26 are provided in the plate 12 for passage of fluid therethrough, and are preferably disposed substantially in the central portion of the plate 12 for alignment with the ports of the carburetor 14 and manifold 16 as will be hereinafter set forth, but not limited thereto. The apertures 26 may be spaced in any desired manner, such as a random pattern of spacing, or in spaced rows of aligned apertures, or spaced rows of offset apertures, as desired, with substantially any desired dimensional spacing therebetween, the only limitation being that the open area of the apertures 26 be sufficient for passing fluid therethrough in sufficient quantities for precluding interference with the normal operation of the engine (not shown) with which the device 10 is to be utilized.

A plurality of spaced detents or indentations 28 are provided in the face 30 of the plate 12, which may be considered as the leading face thereof. The indentations or detents 28 may be of substantially any desired number and of substantially any desired spacing. However, it is preferable that the detents 28 be interposed between adjacent pairs of apertures 26 or in the proximity thereof as particularly shown in FIG. 1.

In use, the plate 12 may be easily interposed between the carburetor 14 and the manifold 16 by removing the usual bolts 24 which are normally provided for securing the carburetor 14 to the manifold 16, and removing the carburetor from connection with the manifold. The carburetor 14 is normally provided with an outlet port 32 which is usually in substantial alignment with an intake port 34 of the manifold 16 whereby an air-fuel mixture may be passed from the carburetor 14 to the manifold 16 for burning of the air-fuel mixture to supply power for the engine (not shown), as is well known. A sealing gasket 36 is normally secured between the carburetor 14 and manifold 16 for precluding leakage of fluid therebetween, and is normally provided with a central aperture 38 complementary to the ports 32 and 34 for passage of fluid therethrough, and is usually of an outer configuration complementary to the outer configuration of the mating elements of the carburetor 14 and manifold 16. It is considered preferable that the outer configuration of the plate 12 be substantially identical with or complementary to the outer configuration of the gasket 38 normally utilized with the carburetor 14 and manifold 16 of the engine (not shown) wherein the device 10 is to be installed.

The gasket 36 may be disposed on the manifold 16 in the usual manner, and the plate 12 may be disposed adjacent the gasket 36. A second gasket 40 substantially identical with the gasket 36 and having a central aperture 42 therein may be disposed on the leading face 30 of the plate 12, and the carburetor 14 may then be disposed against the gasket 40. The bolts 24 may then be utilized in the usual manner for securing the carburetor 14 to the manifold 16, with the plate 12 and the gaskets 36 and 40 interposed therebetween. It will be readily apparent that the gaskets 36 and 40 substantially preclude leakage of fluid between the plate 12 and the carburetor 14 and manifold 16.

The intake port 34 of the manifold 16 is normally disposed in substantial alignment with the "hot spot" of the manifold, and as a consequence, the plate 12 will be heated during the operation of the engine (not shown). As the air-fuel mixture leaves the carburetor 14, it passes across the plate 12 for moving through the apertures 26 and into the manifold 16. The hot plate 12 radiates heat to the air-fuel mixture, which increases the temperature of the mixture for vaporization of a quantity of the air-fuel mixture. In addition, portions of the air-fuel mixture impinge against the leading surface 30 of the plate 12, and are heated by the direct contact with the hot plate 12. This, of course, heats the air-fuel mixture for vaporization of an additional quantity of the mixture. Still additional portions of the air-fuel mixture will accumulate in the detents 28, and the heat of the plate 12 will increase the temperature of the accumulated or trapped droplets of the air-fuel mixture contained within the detents 28 to the boiling point thereof, which, of course, vaporizes still additional quantities of the air-fuel mixture.

The substantially vaporized air-fuel mixture is admitted into the manifold 16 through the apertures 26 and intake port 38. The mixture is introduced into the manifold at the "hot spot" thereof, and substantially all of the air-fuel mixture which has not been previously vaporized by the plate 12 will be vaporized in the "hot spot" area of the manifold. Thus, the air-fuel mixture directed to the combustion chamber (not shown) is substantially completely vaporized. As is well known, vaporized fuel burns much more efficiently and cleanly than fuel which is not vaporized or only partically vaporized. Thus, engine power will be realized from substantially the entire air-fuel mixture, with very little fuel waste, resulting in a greatly increased fuel mileage for the engine. Of course, this also greatly reduces the release of pollutants into the atmosphere in the exhaust system of the engine (not shown).

It is to be noted that the plate 12 as shown herein is a single or unitary structure. However, the plate 12 may be of a laminated type construction comprising a plurality of relatively thin plates (not shown) secured together in any suitable manner to form the plate 12, with one of the layers being a heating element which may be operably connected with the electrical system of the engine (not shown). In this manner, the plate 12 may be preheated without relying on the heat transfer from the manifold during operation of the engine.

It is also to be noted that the device 10 may be adapted for use with substantially any type fuel, such as diesel oil, or the like, and with substantially any type engine wherein increased fuel efficiency may be achieved through vaporization of the fuel. In addition, it may be necessary to recess the manifold or carburetor to countersink the plate 12 therein to provide sufficient clearance in some automobile models.

It has been found that the vaporization of the fuel with the use of device 10 reduces dilution of the lubricating oil in the engine pistons, and the like, which has produced a greater life for the operating parts of the engine. The increased fuel efficiency also reduces vapor lock and stalling of the engine on up grades, and the like. Thus, the device 10 not only increases fuel efficiency and reduces air pollution, but also increases the engine performance and life of the engine components.

From the foregoing it will be apparent that the present invention provides a novel fuel economizer comprising a simple apertured plate adapted to be interposed between the usual carburetor and manifold of an internal combustion engine, or the like, for heating the air-fuel mixture to vaporize substantially all of the fuel prior to discharge thereof into the manifold for distribution to the combustion chamber. The quality of the vaporization results in greatly increased fuel efficiency, reduction of pollutants in the exhaust gases, and greater engine operating efficiency.

Whereas the present invention has been described in particular relation to the drawings attached hereto, it should be understood that other and further modifications, apart from those shown or suggested herein, may be made within the spirit and scope of this invention.

What is claimed is:

1. In combination with a carburetor and manifold, a fuel economizer device comprising an apertured plate member adapted to be interposed between the carburetor and manifold for passing an air-fuel mixture therebetween, said plate member being constructed of a heat conductive material for transmitting heat to the air-fuel mixture passing thereacross whereby substantially all of the air-fuel mixture is vaporized, and wherein the plate member comprises a substantially flat plate constructed of said heat conductive material, a plurality of randomly spaced perforations provided in said plate member for passage of the air-fuel mixture directly therethrough into said manifold, and a plurality of randomly spaced detents provided on the leading face of the plate member for receiving quantities of the air-fuel mixture therein for additional heating and vaporization thereof.

2. In combination with a carburetor and manifold, a fuel economizer device as set forth in claim 1 wherein the plate member is secured in communication with the "hot spot" of the manifold for receiving heat therefrom and for depositing the substantially completely vaporized air-fuel mixture into the manifold at the "hot spot" area for increased vaporization thereof.

3. In combination with a carburetor and manifold, a fuel economizer device as set forth in claim 1 wherein the spaced apertures and detents are centrally disposed in said plate member.

* * * * *